US010504646B2

(12) United States Patent
Salubro et al.

(10) Patent No.: US 10,504,646 B2
(45) Date of Patent: Dec. 10, 2019

(54) NOISE ATTENUATING BARRIER FOR AIR-CORE DRY-TYPE REACTOR

(71) Applicant: Siemens Aktiengesellschaft, München (DE)

(72) Inventors: Sigfrido Salubro, Ontario (CA); Sean Alves, Ontario (CA)

(73) Assignee: SIEMENS AKTIENGESELLSCHAFT, München (DE)

( * ) Notice: Subject to any disclaimer, the term of this patent is extended or adjusted under 35 U.S.C. 154(b) by 391 days.

(21) Appl. No.: 15/637,550

(22) Filed: Jun. 29, 2017

(65) Prior Publication Data

US 2019/0006091 A1 Jan. 3, 2019

(51) Int. Cl.
*H01F 27/33* (2006.01)

(52) U.S. Cl.
CPC ..... *H01F 27/33* (2013.01)

(58) Field of Classification Search
CPC ..... H01F 27/33
USPC ..... 181/202; 336/100
See application file for complete search history.

(56) References Cited

U.S. PATENT DOCUMENTS

| | | | | |
|---|---|---|---|---|
| 2,494,343 A * | 1/1950 | Mannal | G10K 11/16 336/94 |
| 3,309,639 A | 3/1967 | Goolsby, Jr. | |
| 5,202,584 A * | 4/1993 | Burke | H01F 27/085 307/105 |
| 9,576,724 B2 * | 2/2017 | Best | H01F 5/02 |
| 9,601,254 B2 * | 3/2017 | Sharp | H01F 27/2876 |
| 2019/0096570 A1 * | 3/2019 | Griebler | H01F 27/362 |

FOREIGN PATENT DOCUMENTS

| | | |
|---|---|---|
| CN | 105845396 A | 8/2016 |
| WO | 2014186888 A1 | 11/2014 |

OTHER PUBLICATIONS

PCT International Search Report and Written Opinion of International Searching Authority dated Oct. 2, 2018 corresponding to PCT International Application No. PCT/US2018/039886 filed Jun. 28, 2018.

* cited by examiner

*Primary Examiner* — Jeremy A Luks

(57) ABSTRACT

A noise mitigating sound shield comprises an assembly configured for attachment to an air-core dry-type reactor. The assembly is configured for forming a closed cylinder positioned radially outward from an outermost surface of a reactor build of the air-core dry-type reactor. The assembly includes a noise attenuating barrier having an innermost surface. No portion of the outermost surface of the reactor build directly contacts the innermost surface of the noise attenuating barrier limiting structure-borne sound transmission from the reactor build to the noise attenuating barrier.

15 Claims, 9 Drawing Sheets

NOISE ATTENUATING BARRIER FOR AIR-CORE DRY-TYPE REACTOR

BACKGROUND

1. Field

Aspects of the present invention generally relate to mitigating noise from an air-core dry-type reactor with a sound shield and more specifically relate to a noise attenuating barrier positioned radially outward from an outermost surface of a reactor build such that no portion of the outermost surface of the reactor build directly contacts an innermost surface of the noise attenuating barrier.

2. Description of the Related Art

Air core reactors are inductive devices used in high voltage power transmission, distribution and industrial applications. Air core reactors, typically placed in outdoor environments, are formed with a series of concentrically positioned, spaced-apart winding layers, referred to as packages, each having a cylindrical configuration. The winding layers are positioned between upper and lower current carrying members, sometimes referred to as spider units. The spider units comprise a series of arms radiating along a plane and away from a central position in a star configuration.

Among other functions, the spider units may serve as line terminals for connecting power lines and for connecting the winding layers in an electrically parallel configuration. The reactors are normally installed with the spider units occupying a horizontal orientation with respect to an underlying horizontal ground plane so that the major axis of the cylindrical configuration extends vertically upward from the ground plane. For a single reactor, or for the lower-most reactor in a stacked configuration of two or more reactors, the winding layers are supported above the ground by the lower spider unit and a series of insulators and structural leg members which extend from the lower spider unit to the ground.

Sound radiated from air core reactors can be a serious irritant to population groups living nearby. Therefore, attenuation levels of low, medium and high frequency noise generated by an air-core dry-type reactor needs to be increased.

Up to now, the current method of attenuating low, medium and high frequency noise generated by an air-core dry-type reactor is to use a standalone sound shield or to use an integrated sound shield that is secured to the outermost surface of a reactor by means of friction between vertical members of the integrated sound shield and the reactor outermost layer. Other methods utilize vibration dampening members to secure a sound shield to a reactor to minimize structural-borne noise transmission to the sound shield.

The sound noise problem may be solved by using structural vibration dampening methods for securing the noise attenuating barrier to the reactor. However this solution may be affected by temperature changes, may become loose because of vibration and may be less cost effective.

Therefore, there is a need for effectively increasing attenuation levels of low, medium and high frequency noise generated by an air-core dry-type reactor while overcoming various problems and shortcomings of the prior art.

SUMMARY

Briefly described, aspects of the present invention relate to a noise attenuating barrier that increases the attenuation levels of low, medium and high frequency noise generated by an air-core dry-type reactor. The noise attenuating barrier is installed on a reactor coil such that no portion of the outermost surface of the reactor build directly contacts an innermost surface of the noise attenuating barrier. By eliminating the vertical members of a prior art integrated sound shield, no portion of the reactor's outermost layer physically touches the innermost layer of the noise attenuating barrier thus reducing structural-borne noise transmission to the noise attenuating barrier.

In accordance with one illustrative embodiment of the present invention, an air-core dry-type reactor is provided. It comprises a reactor build including a coil and a first spider coupled to the coil. The first spider has a plurality of arms radiating from a central hub. The plurality of arms having free ends each of which having a hook like notch. The reactor build having an outermost surface. The air-core dry-type reactor further comprises a noise attenuating barrier positioned radially outward from the outermost surface of the reactor build. The noise attenuating barrier is held in place using epoxy-impregnated fiberglass ties which are wrapped around the hook like notch. The noise attenuating barrier has an innermost surface. No portion of the outermost surface of the reactor build directly contacts the innermost surface of the noise attenuating barrier limiting structure-borne sound transmission from the reactor build to the noise attenuating barrier. The noise attenuating barrier comprises a plurality of sound absorbing panels each including a plurality of layers. The plurality of layers includes a layer of sound absorbing material on a side closer to the reactor build and a layer of sound barrier material on a side farther from the reactor build.

In accordance with another illustrative embodiment of the present invention, a kit for a noise mitigating sound shield is provided. The kit comprises an assembly configured for attachment to an air-core dry-type reactor. The assembly is configured for forming a closed cylinder positioned radially outward from an outermost surface of a reactor build. The assembly includes a noise attenuating barrier having an innermost surface. No portion of the outermost surface of the reactor build directly contacts the innermost surface of the noise attenuating barrier limiting structure-borne sound transmission from the reactor build to the noise attenuating barrier.

In accordance with another illustrative embodiment of the present invention, a method of mitigating noise from an air-core dry-type reactor with a sound shield is provided. The method comprises providing an assembly configured for attachment to the air-core dry-type reactor. The method further comprises forming from the assembly a closed cylinder positioned radially outward from an outermost surface of a reactor build. The assembly includes a noise attenuating barrier having an innermost surface. No portion of the outermost surface of the reactor build directly contacts the innermost surface of the noise attenuating barrier limiting structure-borne sound transmission from the reactor build to the noise attenuating barrier.

DETAILED DESCRIPTION

Figure 1:
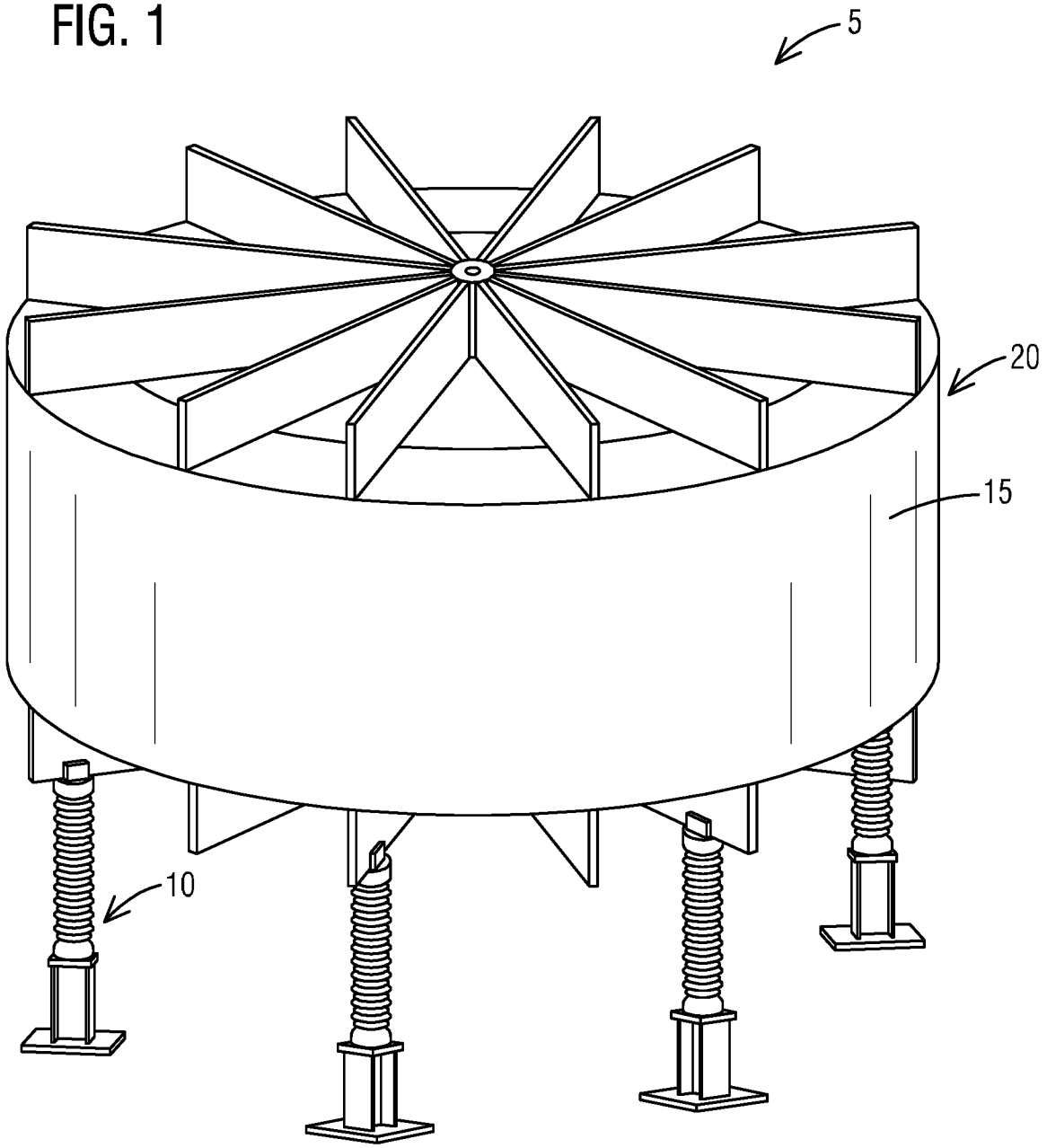
FIG. 1 illustrates a schematic diagram of an air-core dry-type reactor in accordance with an exemplary embodiment of the present invention.

To facilitate an understanding of embodiments, principles, and features of the present invention, they are explained hereinafter with reference to implementation in illustrative embodiments. In particular, they are described in the context of a noise attenuating barrier positioned relative to a reactor build of an air-core dry-type reactor for effectively mitigating sound noise from the air-core dry-type reactor. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

These and other embodiments of a noise attenuating barrier positioned at a gap relative to a reactor build of an air-core dry-type reactor for effectively mitigating sound noise from the air-core dry-type reactor are described below with reference to FIGS. 1-17. The drawings are not necessarily drawn to scale. Like reference numerals are used throughout to denote like elements.

Consistent with one embodiment of the present invention, FIG. 1 represents a schematic diagram of an air-core dry-type reactor 5 in accordance with an exemplary embodiment of the present invention. The air-core dry-type reactor 5 is for use in an electric power transmission and distribution system or in an electric power system of an electrical plant. The air-core dry-type reactor 5 comprises an electrically insulated support structure 10 and an outer surface 15 of a coil 20 of windings configured to operate at a potential and isolated to ground or other potentials by the electrically insulated support structure 10.

As used herein, "air-core dry-type reactor" refers to an air core power reactor for use in an electric power transmission and distribution system or in an electric power system of an electrical plant. The "air-core dry-type reactor," in addition to the exemplary hardware description above, refers to a system that is configured to provide substation equipment electrical functionality. The air-core dry-type reactor can include multiple interacting devices, whether located together or apart, that together perform processes as described herein.

The techniques described herein can be particularly useful for using the air-core dry-type reactor 5. While particular embodiments are described in terms of the air-core dry-type reactor 5, the techniques described herein are not limited to the air-core dry-type reactor 5 but can also use other types of power reactors.

Figure 2:
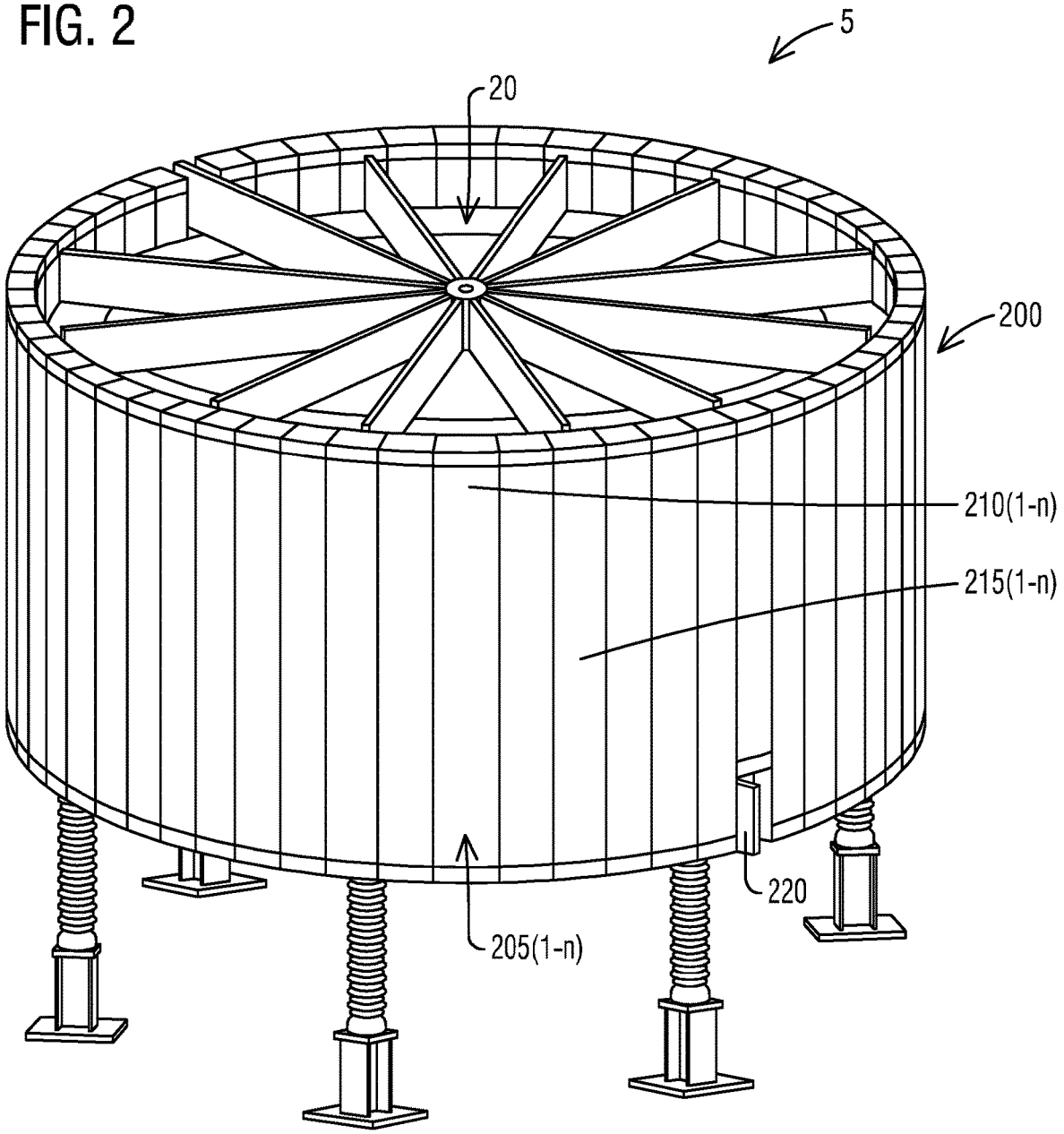
FIG. 2 illustrates a schematic diagram of a noise attenuating barrier that reduces structural-borne noise transmission installed on the air-core dry-type reactor of FIG. 1 in accordance with an exemplary embodiment of the present invention.

Referring to FIG. 2, it illustrates a schematic diagram of a noise attenuating barrier 200 that reduces structural-borne noise transmission installed on the air-core dry-type reactor 5 of FIG. 1 in accordance with an exemplary embodiment of the present invention. The noise attenuating barrier 200 is positioned radially outward from an outermost surface of a reactor build of the air-core dry-type reactor 5 of FIG. 1. The noise attenuating barrier 200 has an innermost surface. No portion of the outermost surface of the reactor build directly contacts the innermost surface of the noise attenuating barrier 200. The noise attenuating barrier 200 extends above and below the coil 20 a distance equal to the spider heights.

In one embodiment, the noise attenuating barrier 200 comprises a plurality of sound absorbing panels **205(1-*n*)** each including a plurality of layers. The plurality of layers includes a layer of sound absorbing material (not shown) on a side closer to the reactor build and a layer of sound barrier material (not shown) on a side farther from the reactor build. For example, the layer of sound absorbing material may be a layer of dense sound absorbing material and the layer of sound barrier material may be a layer of heavy mass sound barrier material.

The plurality of sound absorbing panels 205(1-*n*) include a plurality of sound absorbing filler panels 210(1-*n*) and a plurality of sound absorbing spider panels 215(1-*n*). A sound absorbing spider panel 215 may be installed at a spot where a spider lies. At other locations a group of sound absorbing filler panels 210 may be installed. For example, as shown in FIG. 2 after every 4 sound absorbing filler panels 210 a sound absorbing spider panel 215 is installed. The sound absorbing spider panel 215 at a terminal location 220 is of a different size than the other sound absorbing spider panels 215 in between the plurality of sound absorbing filler panels 210(1-*n*). The plurality of sound absorbing filler panels 210(1-*n*) has a greater width than the plurality of sound absorbing spider panels 215(1-*n*). The plurality of sound absorbing spider panels 215(1-*n*) have two sizes which are different in height.

Figure 3:
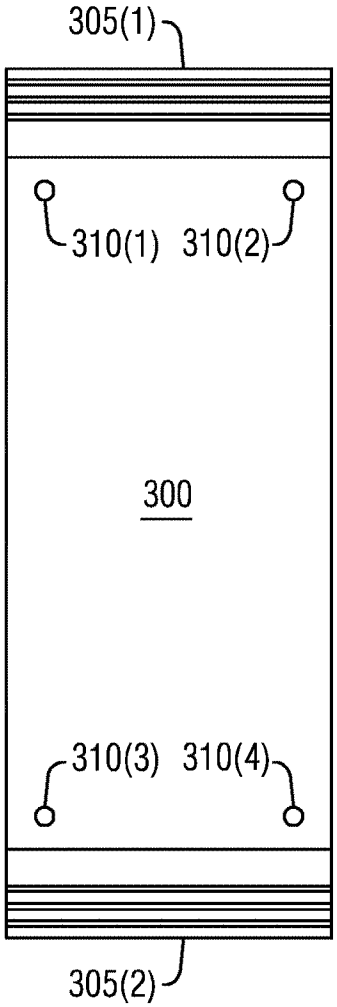
FIG. 3 illustrates a front view of a sound absorbing filler panel of the noise attenuating barrier of FIG. 2 in accordance with an exemplary embodiment of the present invention.

Turning now to FIG. 3, it illustrates a front view of a sound absorbing filler panel 300 of the noise attenuating barrier 200 of FIG. 2 in accordance with an exemplary embodiment of the present invention. The sound absorbing filler panel 300 comprises a layer of sound absorbing material (e.g., single density mineral wool insulation) on inside and a layer of sound barrier material (e.g., high mass elastromeric noise barrier) on outside. The sound absorbing filler panel 300 further comprises a top cap 305(1) and a bottom cap 305(2). The bottom cap 305(2) may have drainage holes drilled into it. The sound absorbing filler panel 300 further comprises a set of pins 310(1-4) which could be nylon pins with a long shank and a flat head for securing the layer of sound barrier material to the layer of sound absorbing material.

Figure 4:
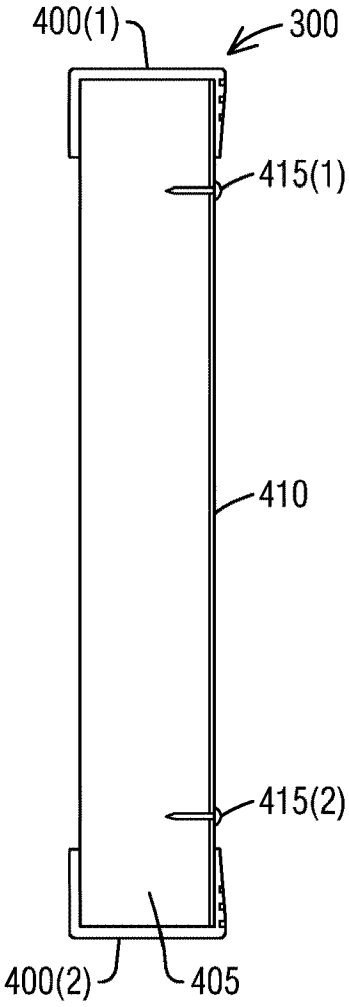
FIG. 4 illustrates a side view of the sound absorbing filler panel of FIG. 3 in accordance with an exemplary embodiment of the present invention.

FIG. 4 illustrates a side view of the sound absorbing filler panel 300 of FIG. 3 in accordance with an exemplary embodiment of the present invention. The plurality of sound absorbing panels including the sound absorbing filler panel 300 having a top surface and a bottom surface such that the top and bottom surfaces of the sound absorbing filler panel 300 include a first and a second polyester-glass mat composite channel 400(1-2) which offer protection from environment to a layer of sound absorbing material 405. The second polyester-glass mat composite channel 400(2) on the bottom surface contains a plurality of drain holes to allow moisture to weep. A layer of sound barrier material 410 is adhered to the layer of sound absorbing material 405 and then the layer of sound barrier material 410 is fastened using pins 415(1-2).

Figure 5:
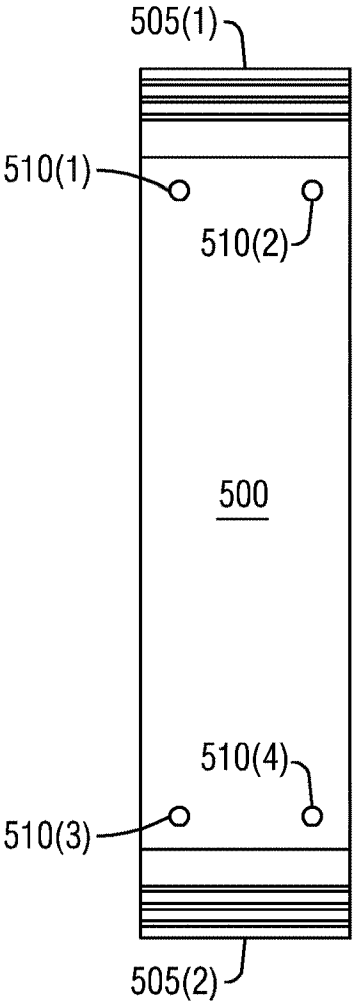
FIG. 5 illustrates a front view of a first sound absorbing spider panel of the noise attenuating barrier of FIG. 2 in accordance with an exemplary embodiment of the present invention.

As seen in FIG. 5, it illustrates a front view of a first sound absorbing spider panel 500 of the noise attenuating barrier 200 of FIG. 2 in accordance with an exemplary embodiment of the present invention. The first sound absorbing spider panel 500 further comprises a top cap 505(1) and a bottom cap 505(2). The bottom cap 505(2) may have drainage holes drilled into it. The first sound absorbing spider panel 500 further comprises a set of pins 510(1-4) which could be nylon pins with a long shank and a flat head for securing the layer of sound barrier material 410 to the layer of sound absorbing material 405.

Figure 6:
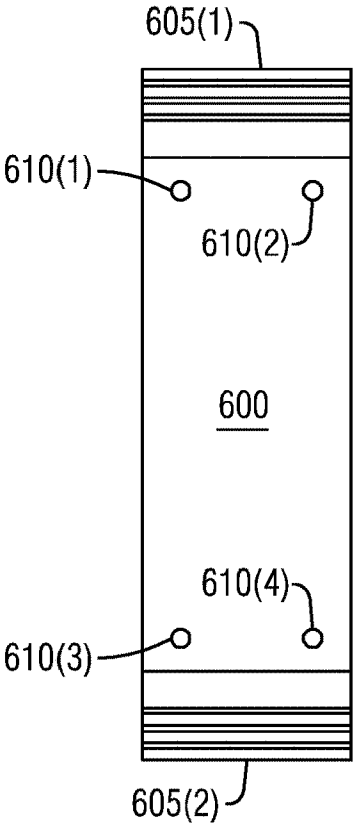
FIG. 6 illustrates a front view of a second sound absorbing spider panel of the noise attenuating barrier of FIG. 2 in accordance with another exemplary embodiment of the present invention.

As shown in FIG. 6, it illustrates a front view of a second sound absorbing spider panel 600 of the noise attenuating barrier 200 of FIG. 2 in accordance with another exemplary embodiment of the present invention. The second sound absorbing spider panel 600 further comprises a top cap 605(1) and a bottom cap 605(2). The bottom cap 605(2) may have drainage holes drilled into it. The second sound absorbing spider panel 600 further comprises a set of pins 610(1-4) which could be nylon pins with a long shank and a flat head for securing the layer of sound barrier material 410 to the layer of sound absorbing material 405.

Figure 7:
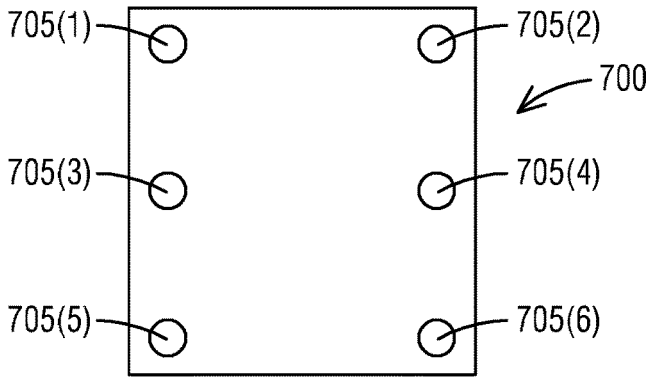
FIG. 7 illustrates a top view of a panel cap of the sound absorbing filler panel of FIG. 3 in accordance with an exemplary embodiment of the present invention.
Figure 8:
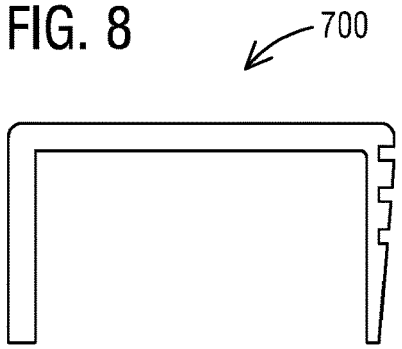
FIG. 8 illustrates a side view of the panel cap of FIG. 7 in accordance with an exemplary embodiment of the present invention.

In FIG. 7, it illustrates a top view of a panel cap 700 of the sound absorbing filler panel 300 of FIG. 3 in accordance with an exemplary embodiment of the present invention. As a bottom cap, it may have drainage holes 705(1-6) drilled into it. FIG. 8 illustrates a side view of the panel cap 700 of FIG. 7 in accordance with an exemplary embodiment of the present invention.

Figure 9:
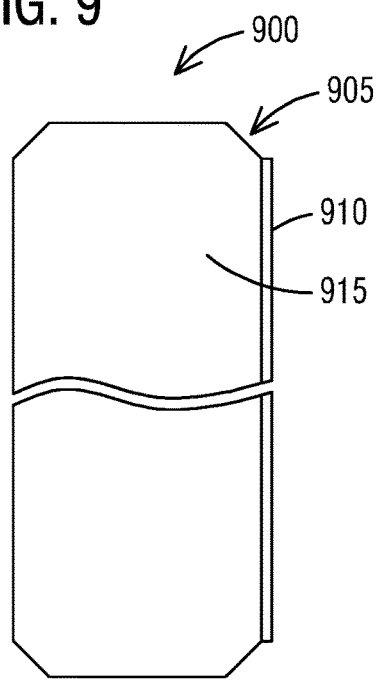
FIG. 9 illustrates a side view of a sound absorbing filler panel with panel chamfers in accordance with an exemplary embodiment of the present invention.

FIG. 9 illustrates a side view of a single sound absorbing filler panel 900 with panel chamfers 905 in accordance with an exemplary embodiment of the present invention. The panel caps are not shown for clarity. As shown, the single sound absorbing filler panel 900 includes a sound barrier layer 910 and a sound absorbing wool layer 915. The ends of the sound absorbing wool layer 915 are chamfered. The length of the sound barrier layer 910 is to be shorter than a total length of the sound absorbing wool layer 915. For example, it could be 1 inch shorter.

Figure 10:
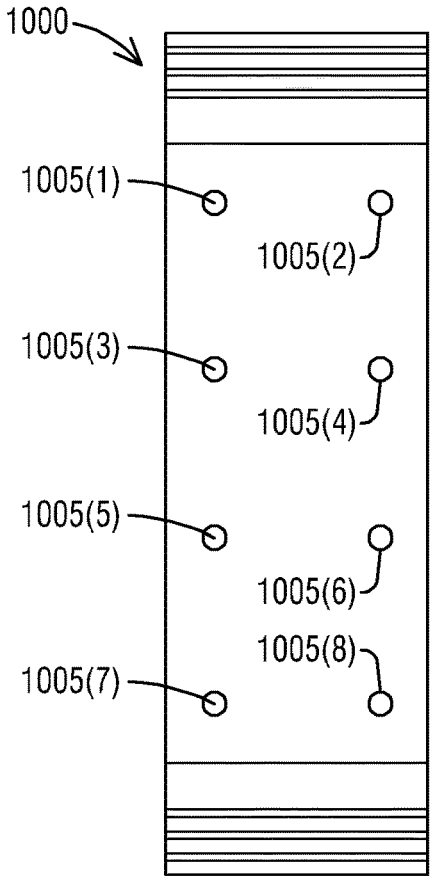
FIG. 10 illustrates a front view of a sound absorbing filler panel with panel pin placement in accordance with an exemplary embodiment of the present invention.

FIG. 10 illustrates a front view of a sound absorbing filler panel 1000 with panel pin placement in accordance with an exemplary embodiment of the present invention. The sound absorbing filler panel 1000 includes equally-spaced securing pins 1005(1-8) securing the sound barrier layer 910 to the sound absorbing wool layer 915. The securing pins 1005(1-8) are to be placed along a length of the sound absorbing filler panel 1000.

Figure 11:
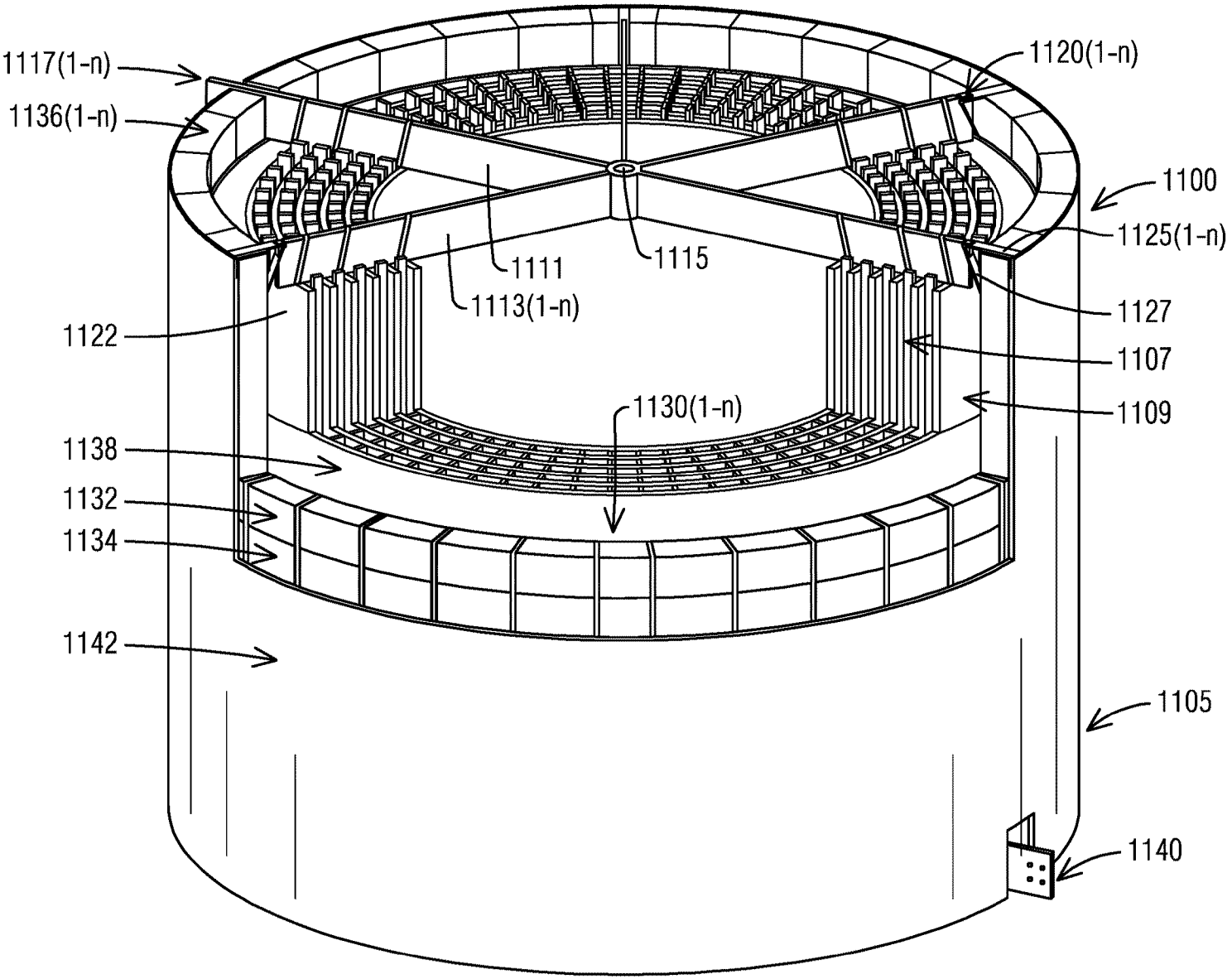
FIG. 11 illustrates an isometric view from top side with a cut-out section of a noise attenuating barrier that reduces structural-borne noise transmission installed on an air-core dry-type reactor in accordance with an exemplary embodiment of the present invention.

FIG. 11 illustrates an isometric view from top side with a cut-out section of a noise attenuating barrier 1100 that reduces structural-borne noise transmission installed on an air-core dry-type reactor 1105 in accordance with an exemplary embodiment of the present invention. The air-core dry-type reactor 1105 comprises a reactor build 1107 including a coil 1109 and a first spider 1111 coupled to the coil 1109. The first spider 1111 having a plurality of arms 1113(1-*n*) radiating from a central hub 1115. The plurality of arms 1113(1-*n*) has free ends 1117(1-*n*) each of which having a hook like notch 1120(1-*n*). The reactor build 1107 includes an outermost surface 1122. The noise attenuating barrier 1100 is positioned radially outward from the outermost surface 1122 of the reactor build 1107.

The separation between the reactor build 1107 and the noise attenuating barrier 1100 is dynamic in nature and may be determined to optimize the noise attenuating barrier 1100 to a frequency range that requires the greatest noise mitigation. One would not optimize it for every reactor because one also needs to consider manufacturability. But an option can be kept open in case there is a requirement to optimize this separation every reactor. The prototype test results show increase in noise attenuation for acoustic frequencies greater than or equal to 600 Hz.

The noise attenuating barrier 1100 further comprises epoxy-impregnated fiberglass ties 1125(1-*n*) such that it is held in place using the epoxy-impregnated fiberglass ties 1125(1-*n*) which are wrapped around the hook like notch 1120(1-*n*). The noise attenuating barrier 1100 includes an innermost surface 1127. No portion of the outermost surface 1122 of the reactor build 1107 directly contacts the innermost surface 1127 of the noise attenuating barrier 1100 limiting structure-borne sound transmission from the reactor build 1107 to the noise attenuating barrier 1100. The noise attenuating barrier 1100 further comprises a plurality of sound absorbing panels 1130(1-*m*) each including a plurality of layers. The plurality of layers includes a layer of dense sound absorbing material 1132 on a side closer to the reactor build 1107 and a layer of heavy mass sound barrier material 1134 on a side farther from the reactor build 1107.

The plurality of sound absorbing panels 1130(1-*m*) includes a top surface and a bottom surface such that the top and bottom surfaces of the plurality of sound absorbing panels 1130(1-*m*) include a first and a second polyester-glass mat composite channel 1136(1-2) which offer protection from environment to the layer of dense sound absorbing material 1132. The second polyester-glass mat composite channel 1136(2) on the bottom surface contains a plurality of drain holes (not seen).

The noise attenuating barrier 1100 further comprises an open layer of epoxy-impregnated fiberglass 1138 which is positioned against the noise attenuating barrier 1100 facing the reactor build 1107. The open layer of epoxy-impregnated fiberglass 1138 is held in place using the epoxy-impregnated fiberglass ties 1125(1-*n*) which are wrapped around the hook like notch 1120(1-*n*) located on the first spider 1111 and a second spider 1140.

The noise attenuating barrier 1100 further comprises a closed layer of epoxy-impregnated fiberglass 1142 which is positioned against an outer layer of the noise attenuating barrier 1100. The closed layer of epoxy-impregnated fiberglass 1142 is held in place using the epoxy-impregnated fiberglass ties 1125(1-*n*) which are wrapped around the hook like notch 1120(1-*n*) located on the first spider 1111 and the second spider 1140. The epoxy-impregnated fiberglass ties 1125(1-*n*) are the only elements of the noise attenuation barrier 1100 that make a physical contact with the first spider 1111 and the second spider 1140. This method of holding the closed layer of epoxy-impregnated fiberglass 1142 with the epoxy-impregnated fiberglass ties 1125(1-*n*) is how it was constructed for the prototype but not necessarily required. The closed layer of epoxy-impregnated fiberglass 1142 can also be held in place solely by the friction between it and the noise attenuating barrier 1100. The epoxy-impregnated fiberglass ties 1125(1-*n*) only contact the spiders 1111, 1140. They do not contact the reactor build 1107.

In one embodiment, a noise attenuating barrier assembly includes the noise attenuating barrier 1100, the open layer of epoxy-impregnated fiberglass 1138 and the closed layer of epoxy-impregnated fiberglass 1142 to form a closed cylindrical shape positioned radially outward from the outermost surface 1122 of the reactor build 1107. A radial separation 1145 between the reactor build 1107 and the noise attenuating barrier 1100 is determined based on a relative frequency range that requires the greatest noise mitigation. The radial separation 1145 or a gap between the reactor build 1107 and the noise attenuating barrier 1100 increases noise attenuation in relatively lower frequency ranges.

Consistent with one embodiment, a kit for a noise mitigating sound shield such as the noise attenuating barrier 1100 is provided. The kit comprises an assembly configured for attachment to the air-core dry-type reactor 1105. The assembly is configured for forming a closed cylinder positioned radially outward from the outermost surface 1122 of the reactor build 1107. The assembly includes the noise attenuating barrier 1100 having the innermost surface 1127. No portion of the outermost surface 1122 of the reactor build 1107 directly contacts the innermost surface 1127 of the noise attenuating barrier 1100 limiting structure-borne sound transmission from the reactor build 1107 to the noise attenuating barrier 1100.

Figure 12:
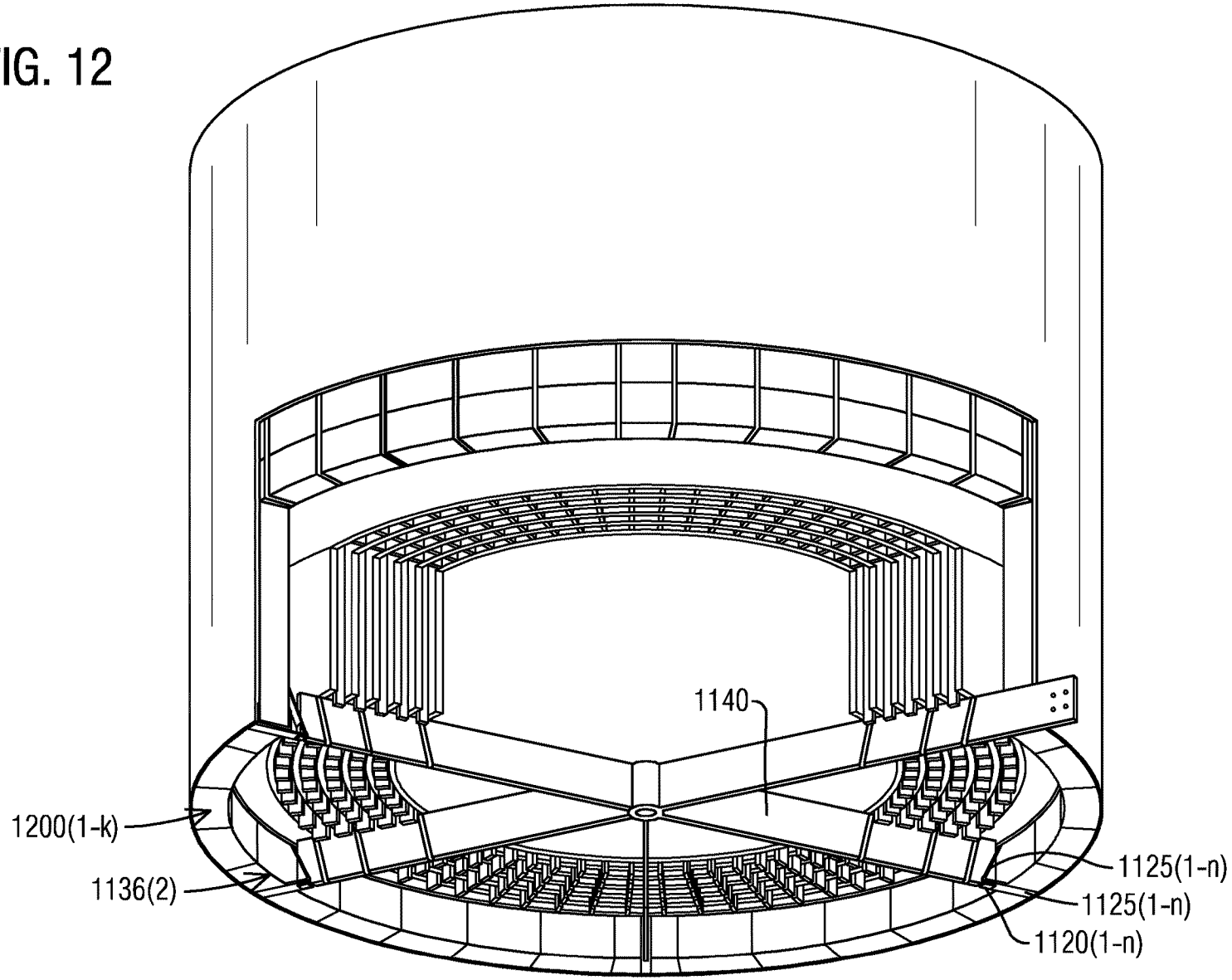
FIG. 12 illustrates an isometric view from bottom side with a cut-out section of a noise attenuating barrier that reduces structural-borne noise transmission installed on an air-core dry-type reactor in accordance with an exemplary embodiment of the present invention.

FIG. 12 illustrates an isometric view from bottom side with a cut-out section of the noise attenuating barrier 1100 that reduces structural-borne noise transmission installed on the air-core dry-type reactor 1105 in accordance with an exemplary embodiment of the present invention. The second polyester-glass mat composite channel 1136(2) on the bottom surface contains a plurality of drain holes 1200(1-*k*) to allow moisture to weep. The epoxy-impregnated fiberglass ties 1125(1-*n*) which are wrapped around the hook like notch 1120(1-*n*) located on the second spider 1140 keep the open layer of epoxy-impregnated fiberglass 1138 and the closed layer of epoxy-impregnated fiberglass 1142 in place.

Figure 13:
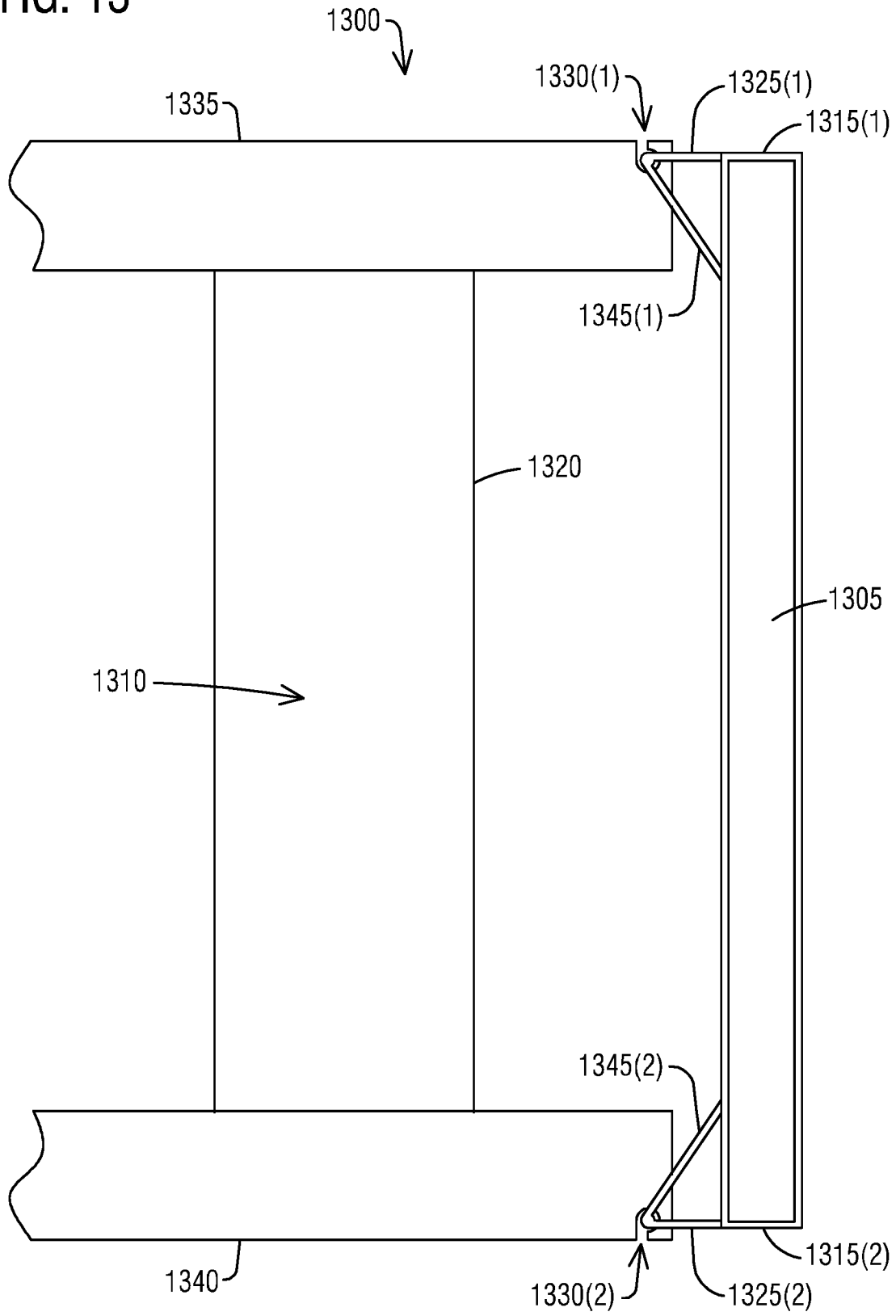
FIG. 13 illustrates a schematic view of a portion of an air-core dry-type reactor which shows position of a noise attenuating barrier relative to a reactor build in accordance with an exemplary embodiment of the present invention.

FIG. 13 illustrates a schematic view of a portion of an air-core dry-type reactor 1300 which shows position of a noise attenuating barrier 1305 relative to a reactor build 1310 in accordance with an exemplary embodiment of the present invention. The noise attenuating barrier 1305 is comprised of a plurality of noise absorbing panels each comprised of a plurality of layers. On the side closer to the reactor build 1310 is a layer of dense sound absorbing material such as mineral wool whereas on the side farther from the reactor build 1310 is a layer of heavy mass sound barrier material such as an EPDM/EVA-based material. On the top and bottom surface of the sound absorbing panels is a polyester-glass mat composite channel 1315(1-2) which offers protection from the environment to the sound absorbing material. The bottom channel 1315(2) contains drain holes to allow moister to weep. The entire sub-assembly is positioned radially outward from an outermost surface 1320 of the reactor build 1310.

The noise attenuating barrier 1305 is positioned against an open layer of epoxy-impregnated fiberglass. The open layer of epoxy-impregnated fiberglass is held in place using epoxy-impregnated fiberglass ties 1345(1-2) which are wrapped around a hook like notch 1330(1-2) located on a top spider 1335 and a bottom spider 1340. Positioned against the outer layer of the noise attenuating barrier 1305 is a closed layer of epoxy-impregnated fiberglass. The closed layer of epoxy-impregnated fiberglass is held in place using epoxy-impregnated fiberglass ties 1325(1-2) which are wrapped around the hook like notch 1330(1-2) located on the top spider 1335 and the bottom spider 1340. The entire noise attenuating barrier assembly forms a closed cylindrical shape positioned radially outward from the outermost surface 1320 of the reactor build 1310. No portion of the noise attenuating barrier assembly touches the reactor build's 1310 outermost surface 1320. The epoxy-impregnated fiberglass ties 1325(1-2), 1345(1-2) are the only elements of the noise attenuation barrier 1305 that makes a contact with the top spider 1335 and the bottom spider 1340.

Figure 14:
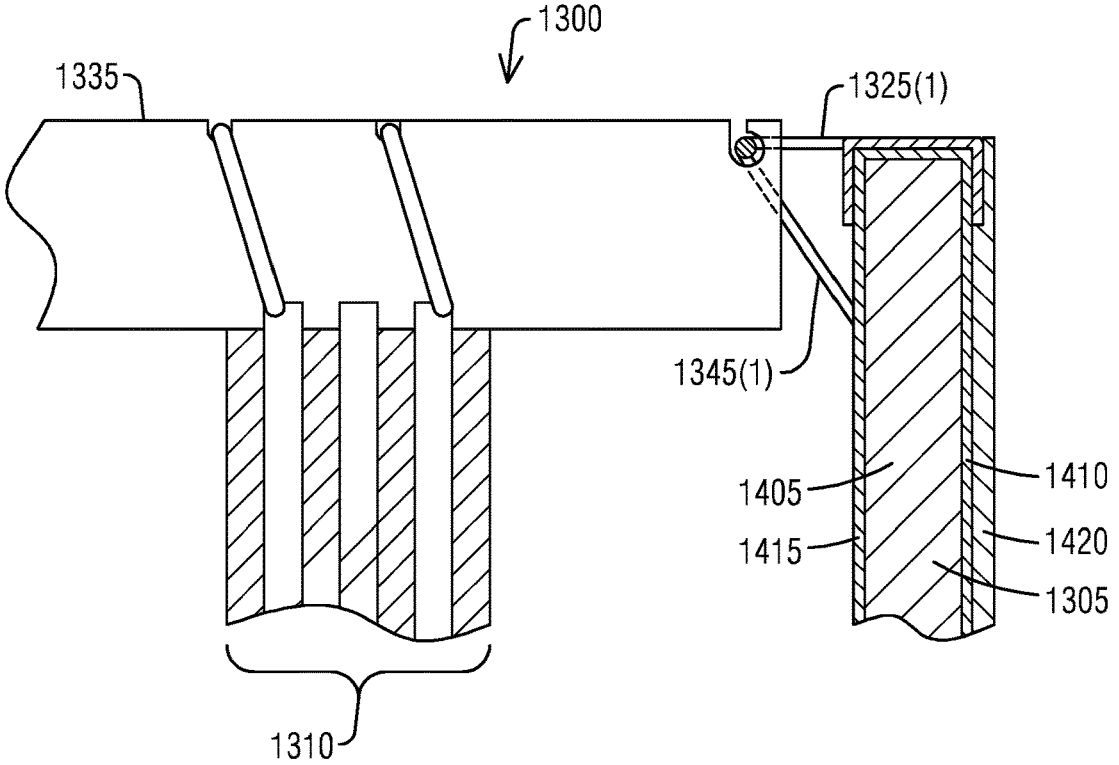
FIG. 14 illustrates a cross sectional view of a portion of an air-core dry-type reactor which shows position of a noise attenuating barrier relative to a reactor build in accordance with an exemplary embodiment of the present invention.

FIG. 14 illustrates a cross sectional view of a portion of the air-core dry-type reactor 1300 which shows position of the noise attenuating barrier 1305 relative to the reactor build 1310 in accordance with an exemplary embodiment of the present invention. The noise attenuating barrier 1305 is comprised of a plurality of noise absorbing panels each comprised of a plurality of layers. On the side closer to the reactor build 1310 is a layer of dense sound absorbing material such as mineral wool 1405 whereas on the side farther from the reactor build 1310 is a layer of heavy mass sound barrier material such as an EPDM/EVA-based material 1410. On the top and bottom surface of the sound absorbing panels is the polyester-glass mat composite channel 1315(1-2) which offers protection from the environment to the sound absorbing material. The noise attenuating barrier 1305 is positioned against an open layer of epoxy-impregnated fiberglass 1415. The open layer of epoxy-impregnated fiberglass 1415 is held in place using epoxy-impregnated fiberglass ties 1345(1-2) which are wrapped around the hook like notch 1330(1-2) located on the top spider 1335 and the bottom spider 1340. Positioned against the outer layer of the noise attenuating barrier 1305 is a closed layer of epoxy-impregnated fiberglass 1420. The closed layer of epoxy-impregnated fiberglass 1420 is held in place using epoxy-impregnated fiberglass ties 1325(1-2) which are wrapped around the hook like notch 1330(1-2) located on the top spider 1335 and the bottom spider 1340.

Figure 15:
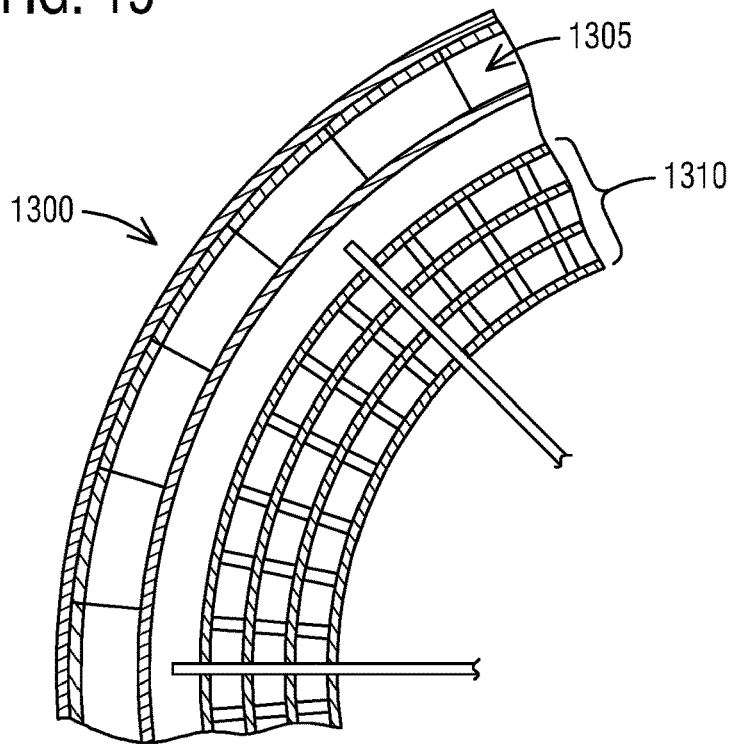
FIG. 15 illustrates a cross sectional view of a portion of an air-core dry-type reactor from top which shows position of a noise attenuating barrier relative to a reactor build in accordance with an exemplary embodiment of the present invention.

FIG. 15 illustrates a cross sectional view of a portion of the air-core dry-type reactor 1300 from top which shows position of the noise attenuating barrier 1305 relative to the reactor build 1310 in accordance with an exemplary embodiment of the present invention. The noise attenuating barrier 1305 forms an assembly which can be integrated with the convectional manufacturing process for air-core reactors. The described assembly constitutes a durable pre-insulated reactor shell which provides a cost effect noise mitigating solution compared to the installation of a separate enclosure. The noise attenuating barrier provides noise mitigation in multiple frequency ranges. In the relatively higher ranges, for example, acoustic frequencies higher than 600 Hz, dense sound absorbing materials incorporated in the sub-assembly directly absorbs acoustic radiation. In the relatively lower frequency ranges, for example, acoustic frequencies lower than 600 Hz, heavy mass sound barrier materials incorporated in the sub-assembly directly "reduce" or "minimize" or "limit" the transmission of acoustic radiation through the noise attenuating barrier 1305. Avoiding direct contact between the noise attenuating barrier 1305 and the reactor build 1310 limits structure borne sound transmission from the reactor build 1310 to the noise attenuating barrier 1305. This increases the noise attenuating capability of the described assembly in the relatively lower frequency ranges, for example acoustic frequencies lower than 600 Hz.

Figure 16:
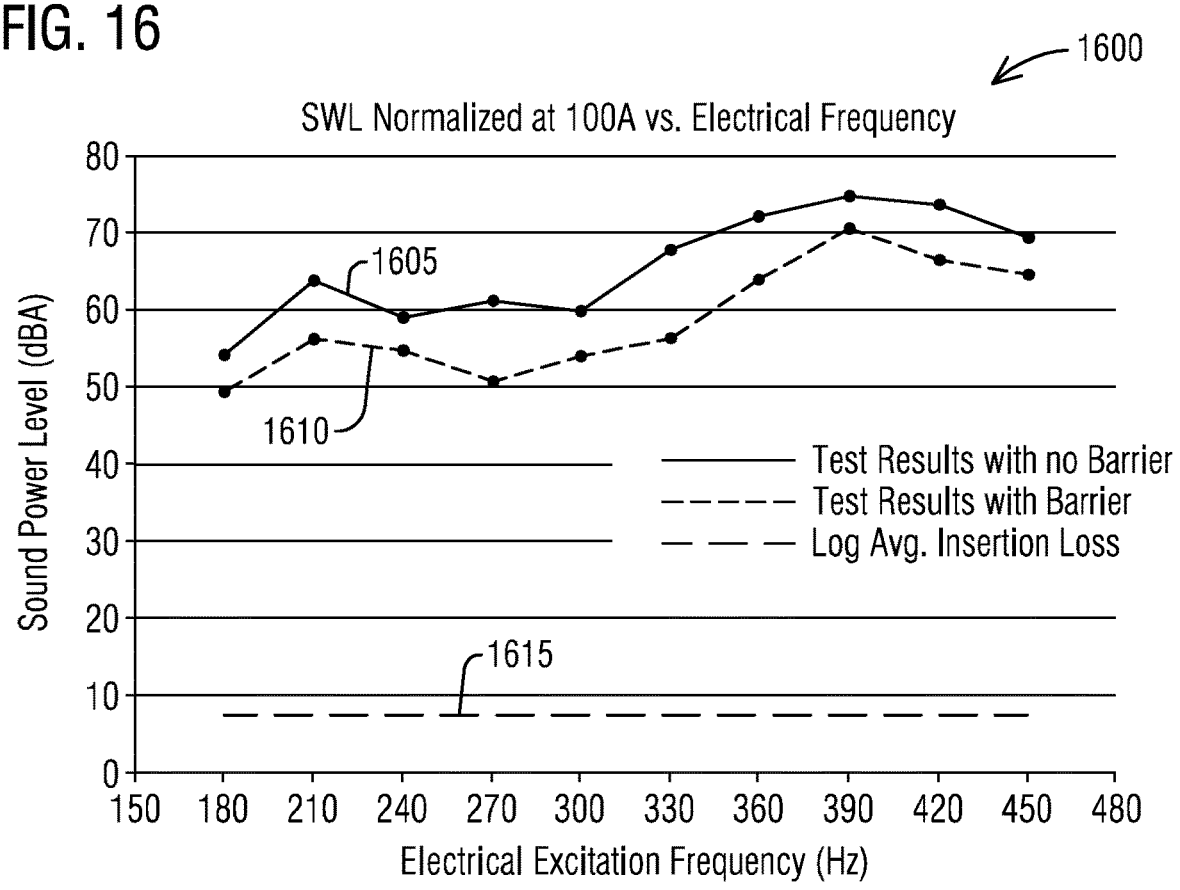
FIG. 16 illustrates a chart of test results with and without a noise attenuating barrier according to an exemplary embodiment of the present invention.

FIG. 16 illustrates a chart 1600 of test results with and without a noise attenuating barrier according to an exemplary embodiment of the present invention. The chart 1600 depicts normalized test data of a prototype air-core reactor used to support the functionality of the noise attenuating barrier 200. A top line 1605 shows the normalized sound power levels of the prototype air core reactor at various electrical excitation frequencies without the noise attenuating barrier 200 installed. A middle line 1610 shows the normalized sound power levels of the same prototype air-core reactor at the same electrical excitation frequencies with the noise attenuating barrier 200 installed. A bottom line 1615 shows the log average Insertion Loss achieved across the measured electrical excitation frequencies by installing the noise attenuating barrier 200 onto the prototype air-core reactor.

Figure 17:
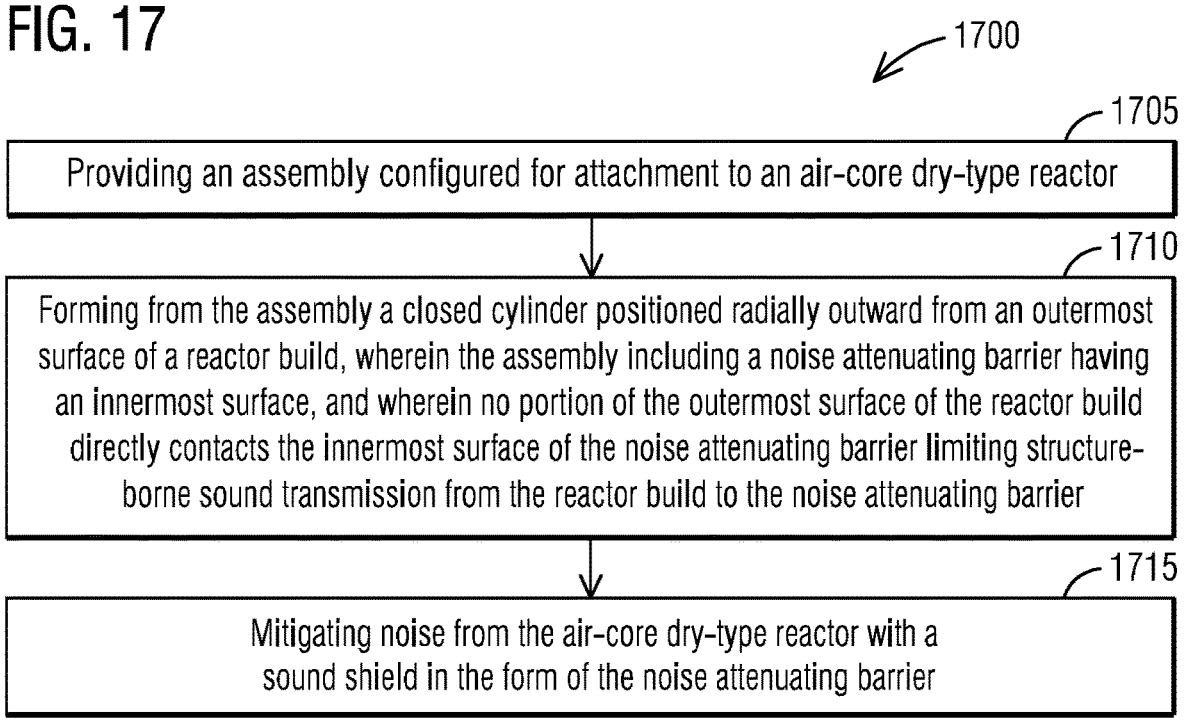
FIG. 17 illustrates a flow chart of a method of mitigating noise from an air-core dry-type reactor with a sound shield according to an exemplary embodiment of the present invention.

FIG. 17 illustrates a flow chart of a method 1700 of mitigating noise from the air-core dry-type reactor 5 with a sound shield such as the noise attenuating barrier 200 according to an exemplary embodiment of the present invention. Reference is made to the elements and features described in FIGS. 1-16. It should be appreciated that some steps are not required to be performed in any particular order, and that some steps are optional.

In step 1705, the method 1700 includes providing an assembly configured for attachment to the air-core dry-type reactor 5. The method 1700 further includes, in step 1710, forming from the assembly a closed cylinder positioned radially outward from an outermost surface of a reactor build. The assembly includes the noise attenuating barrier 200 having an innermost surface. No portion of the outermost surface of the reactor build directly contacts the innermost surface of the noise attenuating barrier 200 limiting structure-borne sound transmission from the reactor build to the noise attenuating barrier 200. The method 1700 further includes, in step 1715, mitigating noise from the air-core dry-type reactor 5 with a sound shield such as the noise attenuating barrier 200. The method 1700 further includes providing a plurality of sound absorbing panels for the noise attenuating barrier 200.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. An air-core dry-type reactor, comprising:

a reactor build including a coil and a first spider coupled to the coil, the first spider having a plurality of arms radiating from a central hub, the plurality of arms having free ends each of which having a hook like notch, the reactor build having an outermost surface; and a noise attenuating barrier positioned radially outward from the outermost surface of the reactor build, wherein the noise attenuating barrier is held in place using epoxy-impregnated fiberglass ties which are wrapped around the hook like notch, the noise attenuating barrier having an innermost surface, wherein no portion of the outermost surface of the reactor build directly contacts the innermost surface of the noise attenuating barrier limiting structure-borne sound transmission from the reactor build to the noise attenuating barrier, and wherein the noise attenuating barrier comprises a plurality of sound absorbing panels each including a plurality of layers, the plurality of layers includes a layer of sound absorbing material on a side closer to the reactor build and a layer of sound barrier material on a side farther from the reactor build.

2. The air-core dry-type reactor of claim 1, wherein the plurality of sound absorbing panels having a top surface and a bottom surface such that the top and bottom surfaces of the plurality of sound absorbing panels include a polyester-glass mat composite channel which offers protection from environment to the layer of sound absorbing material.

3. The air-core dry-type reactor claim 2, wherein the polyester-glass mat composite channel on the bottom surface contains a plurality of drain holes to allow moisture to weep.

4. The air-core dry-type reactor of claim 1, wherein an open layer of epoxy-impregnated fiberglass is positioned against the noise attenuating barrier facing the reactor build.

5. The air-core dry-type reactor of claim 4, wherein the open layer of epoxy-impregnated fiberglass is held in place using the epoxy-impregnated fiberglass ties which are wrapped around the hook like notch located on the first spider and a second spider.

6. The air-core dry-type reactor of claim 1, wherein a closed layer of epoxy-impregnated fiberglass is positioned against an outer layer of the noise attenuating barrier.

7. The air-core dry-type reactor of claim 6, wherein the closed layer of epoxy-impregnated fiberglass is held in place using the epoxy-impregnated fiberglass ties which are wrapped around the hook like notch located on the first spider and a second spider.

8. The air-core dry-type reactor of claim 1, wherein a noise attenuating barrier assembly including the noise attenuating barrier, an open layer of epoxy-impregnated fiberglass and a closed layer of epoxy-impregnated fiberglass forms a closed cylindrical shape positioned radially outward from the outermost surface of the reactor build.

9. The air-core dry-type reactor of claim 1, wherein the epoxy-impregnated fiberglass ties are the only elements of the noise attenuation barrier that make a physical contact with the first spider and a second spider.

10. The air-core dry-type reactor of claim 1, wherein a radial separation between the reactor build and the noise attenuating barrier is determined based on a relative frequency range that requires the greatest noise mitigation or the radial separation is optimized to provide the greatest noise reduction of a particular frequency.

11. The air-core dry-type reactor of claim 1, wherein a gap between the reactor build and the noise attenuating barrier increases noise attenuation in relatively lower frequency ranges.

12. A kit for a noise mitigating sound shield, the kit comprising: an assembly configured for attachment to an air-core dry-type reactor, wherein the assembly is configured for forming a closed cylinder positioned radially outward from an outermost surface of a reactor build, wherein the reactor build including a coil and a first spider coupled to the coil, the first spider having a plurality of arms radiating from a central hub, the plurality of arms having free ends each of which having a hook like notch, wherein the assembly including a noise attenuating barrier having an innermost surface, wherein the noise attenuating barrier is positioned radially outward from the outermost surface of the reactor build, wherein the noise attenuating barrier is held in place using epoxy-impregnated fiberglass ties which are wrapped around the hook like notch, and wherein no portion of the outermost surface of the reactor build directly contacts the innermost surface of the noise attenuating barrier limiting structure-borne sound transmission from the reactor build to the noise attenuating barrier, and wherein the noise attenuating barrier comprises a plurality of sound absorbing panels each including a plurality of layers, the plurality of layers includes a layer of sound absorbing material on a side closer to the reactor build and a layer of sound barrier material on a side farther from the reactor build.

13. The kit of claim 12, wherein the plurality of sound absorbing panels having a top surface and a bottom surface such that the top and bottom surfaces of the sound absorbing panels include a polyester-glass mat composite channel which offers protection from environment to the layer of dense sound absorbing material.

14. The kit of claim 12, wherein the noise attenuating barrier is installed against an open layer of epoxy-impregnated fiberglass.

15. The kit of claim 14, wherein the noise attenuating barrier is wrapped with a closed layer of epoxy-impregnated fiberglass.

* * * * *